US010145031B2

(12) United States Patent
Grob

(10) Patent No.: US 10,145,031 B2
(45) Date of Patent: Dec. 4, 2018

(54) METALLIC CARD CLOTHING

(71) Applicant: Graf + Cie AG, Rapperswil (CH)

(72) Inventor: Willy Grob, Wil (CH)

(73) Assignee: Graf + Cie AG, Rapperswil (CH)

( * ) Notice: Subject to any disclaimer, the term of this patent is extended or adjusted under 35 U.S.C. 154(b) by 100 days.

(21) Appl. No.: 15/079,805

(22) Filed: Mar. 24, 2016

(65) Prior Publication Data

US 2017/0137973 A1 May 18, 2017

(30) Foreign Application Priority Data

Nov. 12, 2015 (CH) ..... 1644/15

(51) Int. Cl.
*D01G 15/88* (2006.01)
*D01G 15/26* (2006.01)

(52) U.S. Cl.
CPC ..... *D01G 15/88* (2013.01); *D01G 15/26* (2013.01)

(58) Field of Classification Search
CPC ..... D01G 15/88
USPC ..... 19/144; D15/78
See application file for complete search history.

(56) References Cited

U.S. PATENT DOCUMENTS 4,651,387 A * 3/1987 Giuliani ..... D01G 15/88 19/113
5,581,848 A * 12/1996 Egerer ..... D01G 15/88 19/113
6,408,487 B1 * 6/2002 Atkinson ..... D01G 15/88 19/114
8,590,110 B2 * 11/2013 Iten ..... D01G 15/88 19/114
8,689,667 B2 * 4/2014 Butzen ..... B23D 61/121 30/355
9,145,625 B2 * 9/2015 Zhang ..... D01G 15/88
9,404,201 B2 * 8/2016 Zhang ..... D01G 15/88
9,663,877 B2 * 5/2017 Zhang ..... D01G 15/88
2004/0010890 A1 * 1/2004 Maidel ..... D01G 15/88 19/98
2012/0255143 A1 * 10/2012 Iten ..... D01G 15/88 19/106 R
2014/0259537 A1 * 9/2014 Zhang ..... D01G 15/88 19/114

(Continued)

FOREIGN PATENT DOCUMENTS

CN 204738066 U 11/2015
JP S 52244247 U 2/1977
JP 2005320662 A 11/2005

(Continued)

OTHER PUBLICATIONS

Swiss Patent Office Search Report, dated Nov. 30, 2015.
EPO Search Report, dated Mar. 31, 2017.

*Primary Examiner* — Shaun R Hurley
(74) *Attorney, Agent, or Firm* — Dority & Manning, P.A.

(57) ABSTRACT

A card clothing wire (1) for use on drums in cards has a root (2) and a blade (3) having an overall height of the wire ($h_1$) of 1.5 mm to 5 mm. The blade (3) is provided with teeth (4) having a tooth depth ($h_6$) of 0.35 mm to 1.0 mm, and having a tooth pitch (p) of 1.5 mm to 3 mm. The teeth (4) have a tip surface (7), a back surface (8) having a back angle (γ), and a tooth face surface. The back angle (γ) is 40° to 20° and each tooth (4) has a first tip (5) and a second tip (6) and the tip surface (7) has at least one elevation (9).

10 Claims, 1 Drawing Sheet

(56) References Cited

U.S. PATENT DOCUMENTS

Figure 1:
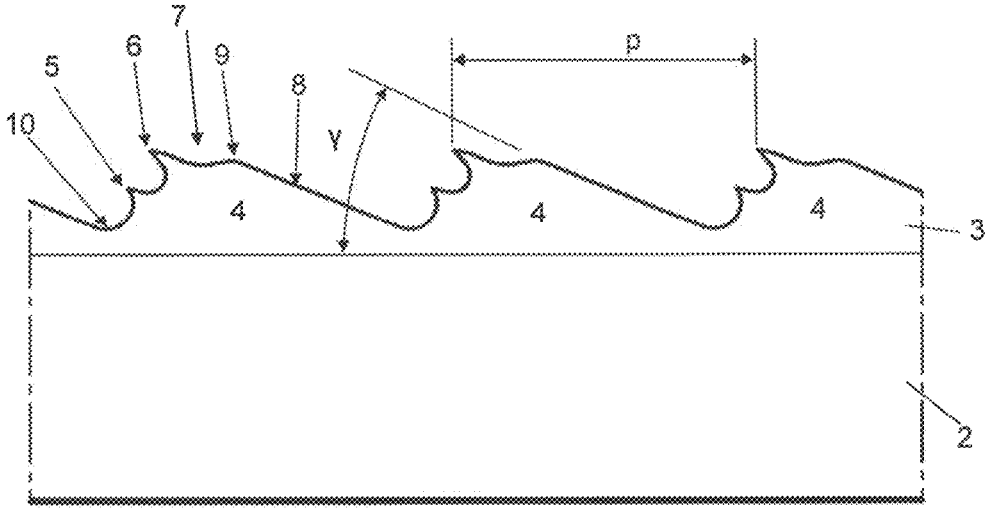

2014/0338154 A1* 11/2014 Zhang ..... D01G 15/88
19/99

FOREIGN PATENT DOCUMENTS

| | | | |
|---|---|---|---|
| WO | WO 02/40233 | A2 | 5/2002 |
| WO | WO 03/087446 | A2 | 10/2003 |
| WO | WO 2013/037711 | A1 | 3/2013 |

* cited by examiner

METALLIC CARD CLOTHING

FIELD OF THE INVENTION

The present invention relates to a metallic card clothing for use on drums in cards.

BACKGROUND OF THE INVENTION

Metallic card clothings are used in different areas of the processing of textile fibers. The present invention relates to a card clothing wire for use on rollers in fiber-processing processes, in particular on drums of cards. When used on rollers, the card clothing wire, in the form of a saw-tooth metallic card clothing, is wound onto the roller in a coil shape and closely adjacent to one another or in grooves. Usual forms of saw-tooth metallic card clothings are described in the international standard ISO 5234 (2004). Metallic card clothings are characterized according to the standard, inter alia, by their back angle $\gamma$, their tooth pitch p and the tooth depth $h_6$, the overall height of the wire $h_1$, and the blade width at the tip $b_3$. The back angle $\gamma$ is the angle between the back surface and the wire base, wherein the back surface is the rear tooth surface as viewed in the direction of motion. If the back angle is 90°, the back surface is therefore situated perpendicularly, or vertically, with respect to the wire base.

In the fiber-processing processes such as opening and cleaning fibers or fiber tufts, high requirements are placed on the metallic card clothings which are used, in particular with respect to possible fiber damage. The fiber transfer from a first roller to a further roller is also considered to be highly significant. In the case of a card, this mainly relates to the metallic card clothing mounted on the drum and to the fiber transfer from the drum to the doffer, i.e., the properties of the metallic card clothing with respect to low fiber damage and good fiber handing-off behavior.

SUMMARY OF THE INVENTION

An object of the invention is to create a card clothing wire which makes it possible to reduce fiber damage in combination with an improved fiber transfer to the subsequent roller. Additional objects and advantages of the invention will be set forth in part in the following description, or may be obvious from the description, or may be learned through practice of the invention.

The objects are achieved by the features of a metallic card clothing described and claimed herein.

In order to achieve the objects, a card clothing wire for use on drums in cards is proposed, wherein the card clothing wire consists of a root and a blade having an overall height of the wire $h_1$ of 1.5 mm to 5.0 mm. Preferably, the overall height of the wire $h_1$ is 1.8 mm to 3.0 mm, particularly preferably 2.0 mm. The blade is provided with teeth having a tooth depth $h_6$ of 0.35 mm to 1.0 mm, preferably the tooth depth $h_6$ is 0.4 mm to 0.6 mm, particularly preferably 0.45 mm. The card clothing wire has a tooth pitch p of 1.5 mm to 3.0 mm, preferably the tooth pitch p is 1.6 mm to 2.0 mm, particularly preferably 1.67 mm (corresponding to 15 tips per inch). The teeth have a tip surface, a back surface having a back angle, and a tooth face surface. The back angle is 40° to 20°, preferably 20° to 30°, particularly preferably 23°. Each tooth has a first tip and a second tip and the tip surface has at least one elevation.

Due to this geometry of the teeth having two tips, a tip surface, and a back surface sloping downward toward a tooth base at a small back angle, the fiber transfer, the handing off of the fibers to a subsequent roller, is favorably affected. In addition, the two tips per tooth also advantageously affect the fiber transfer and result in a considerable reduction of fiber damage. The tip surface having the provided elevation ensures that the fibers are held on the surface of the card clothing. A cushion, which is promoted by the back surface, nevertheless forms in the card clothing root, which cushion likewise effectuates a reduction of fiber damage.

In an advantageous embodiment, a tooth face surface, which extends from the tooth base to the tooth tip in conventional metallic card clothings, is formed by the first tip. In this connection, the first tip is connected to the tooth base by means of a first concave, or semicircular, surface segment. The concave first surface segment between the tooth base and the first tip advantageously has a tooth base radius of 0.1 mm to 0.7 mm, preferably the tooth base radius is 0.1 mm to 0.3 mm. The first tip is connected to the second tip via a second concave, or semicircular, surface segment which advantageously has a radius of 0.05 mm to 0.5 mm, preferably the radius is 0.08 mm to 0.3 mm.

In addition, it is advantageous when the tip surface, in entirety, is not designed as a planar surface, but rather has a tip surface radius of 0.2 mm to 0.5 mm. This tip surface which is designed with the tip surface radius begins a few hundredths of a millimeter after the actual second tip and transitions into the elevation. This has the advantage that a pronounced second tip forms. The entire tip surface is therefore composed of multiple tip surface segments.

A first tip surface segment between the second tip and the tip surface provided with a tip surface radius is designed as a planar surface having a length of 0.03 mm to 0.15 mm and a tip surface angle of 6° to 10°. The tip surface angle is the angle between the tip surface and the wire base. Due to this design of the second tip, it is possible to carry out regrinding without this changing the actual tooth geometry. The service life of the metallic card clothing up to the point of a necessary replacement is therefore extended severalfold.

A second tip surface segment, which follows the first tip surface segment, is concave and is provided with the tip surface radius. A third tip surface segment, which follows the second tip surface segment, is formed by the elevation. The elevation advantageously has a radius of 0.1 mm to 0.3 mm. An elevation is understood to mean that the tip surface which, starting at the second tip, approaches the wire base as the distance from the second tip increases, but moves away from the wire base at the point of the third tip surface segment formed by the elevation. In an advantageous embodiment, the elevation has a height difference with respect to the second tip of 0.02 mm to 0.5 mm. The second tip extends above the elevation by this height difference, which also contributes to an improvement in the possibilities for a regrinding of the card clothing wire.

The back surface follows the third tip surface segment which is designed as an elevation. In an alternative embodiment, another tip surface segment which is designed as another elevation is situated subsequent to the third tip surface segment. The height difference of this further elevation with respect to the second tip is greater than or equal to the height difference of the first elevation with respect to the second tip.

In an advantageous embodiment, the card clothing wire has a blade width at the second tip of 0.05 mm to 0.3 mm, and a root width of 0.3 mm to 1.0 mm.

The card clothing wire can be designed having a normal, an interlocked, or an interlinked root in order to also enable mounting on a smooth roller or in grooves.

The card clothing is suited, in particular, for clothed rollers of cards, such as, for example, the drums. When the card clothing wire is used on a drum, it is mounted in a spiral shape.

BRIEF DESCRIPTION OF THE INVENTION

The invention shall be described in greater detail in the following by means of an exemplary embodiment and by reference to drawings.

Figure 2:
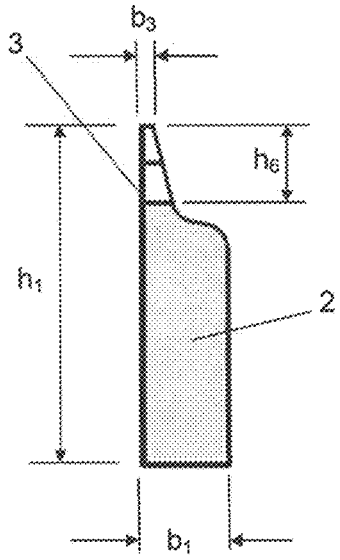
Figure 3:
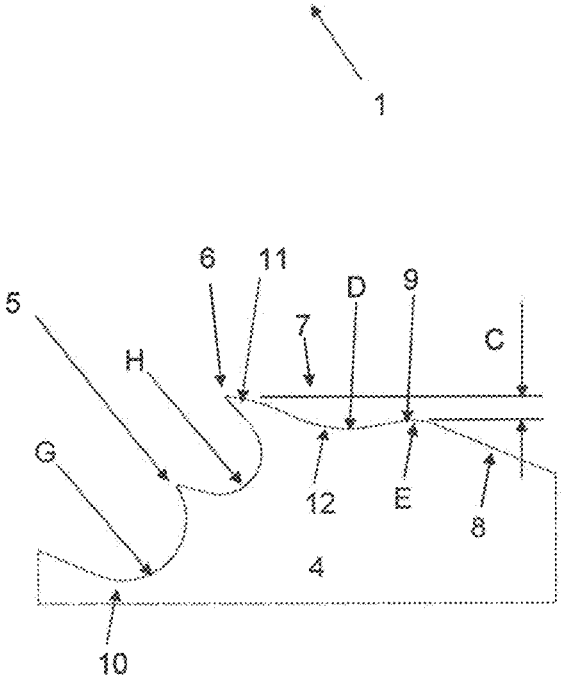

FIG. 1 shows a schematic illustration of a view of an embodiment of a card clothing wire, FIG. 2 shows a schematic illustration of a cross-section of the card clothing wire according to FIG. 1, and FIG. 3 shows an enlarged schematic illustration of a single tooth of the card clothing wire according to FIG. 1.

DETAILED DESCRIPTION

Reference will now be made to the embodiments of the invention, one or more examples of which are shown in the drawings. Each embodiment is provided by way of explanation of the invention, and not as a limitation of the invention. For example features illustrated or described as part of the one embodiment can be combined with another embodiment to yield still another embodiment. It is intended that the present invention include these and other modifications and variations to the embodiments described herein.

FIG. 1 shows a schematic illustration of a view and FIG. 2 shows a cross-section of an embodiment of a card clothing wire 1 having a root 2 and a blade 3. The root 2 and the blade 3 extend extend along the overall height $h_1$ of 2.0 mm. The blade 3 is provided with teeth 4 which are sequentially disposed along the card clothing wire 1 with a certain spacing, the so-called tooth pitch p. The teeth 4 are disposed regularly and identically in terms of their shape along the card clothing wire 1 with a tooth pitch p of 15 tips per inch. The blade 3 formed on the root 2 tapers starting at the root 2 up to a blade width $b_3$ of 0.06 mm at the second tip 6. The root 2 has a root width $b_1$ of 0.5 mm on the side opposite the second tip. The teeth 4 have a tooth depth $h_6$ of 0.45 mm and end, on the side opposite the root 2, in a second tip 6. The tooth depth $h_6$ extends from the second tooth tip 6 to the tooth base 10.

Each tooth 4 has a first tip 5 and a second tip 6. In this connection, the first tip 5 forms the front side of the tooth 4, the so-called face surface. A tip surface 7 is formed from the second tip 6 to the tooth base 10, wherein the tip surface 7 includes an elevation 9 having a subsequent back surface 8. The back surface 8 extends at a back angle γ of 23° at a slant with respect to the tooth base 10.

FIG. 3 shows an enlarged schematic illustration of a single tooth 4 of the card clothing wire 1 according to FIG. 1. From the tooth base 10 to the second tip 6, the face surface of the tooth 4 is shown, wherein this is formed to the first tip 5. The tooth base 10 is connected to the first tip 5 via a first concave surface segment which has a tooth base radius G of 0.15 mm. The first tip 5 is connected to the second tip 6 via a second concave surface element which has a radius H of 0.1 mm.

The second tip 6, in turn, is connected to the subsequent tooth base by means of a tip surface 7 and a subsequent back surface 8. The tip surface 7 is composed of multiple tip surface segments 11, 12, 9. The first tip surface segment 11, proceeding from the second tip, is formed by a planar surface. The second tip surface segment 12 following the first tip surface segment 11 is designed as a convex surface having a radius D of 0.3 mm. The third tip surface segment is formed by the elevation 9. The elevation 9 has a radius E of 0.15 mm and, at its highest point, has a height difference C of 0.08 mm with respect to the second tip 6.

Modifications and variations can be made to the embodiments illustrated or described herein without departing from the scope and spirit of the invention as set forth in the appended claims.

LEGEND

1 card clothing wire
2 root
3 blade
4 tooth
5 first tip of a tooth
6 second tip of a tooth
7 tip surface
8 back surface
9 elevation
10 tooth base
11 first tip surface segment
12 second tip surface segment
γ back angle
$h_1$ overall height of the wire
$h_6$ tooth depth
C height difference
D tip surface radius
E radius of the elevation
p tooth pitch
G tooth base radius to the first tip
H radius from the first to the second tip
$b_1$ root width
$b_3$ blade width at the tip

The invention claimed is:

1. A card clothing wire for use on drums in cards, comprising:
- a root;
- a blade comprising a blade base;
- the root and blade having an overall height of the wire of 1.5 mm to 5 mm;
- teeth provided on the blade and having a tooth depth of 0.35 mm to 1.0 mm, and having a tooth pitch of 1.5 mm to 3 mm;
- the teeth comprising a tip surface, a back surface having a back angle from 40° to 20°, and a tooth face surface;
- each tooth comprising a first tip and a second tip;
- the tip surface comprising at least one elevation;
- the first tip formed in the tooth face surface; and
- wherein the first tip is connected to the tooth base via a first concave surface segment having a tooth base radius of 0.1 mm to 0.5 mm.

2. The card clothing wire according to claim 1, wherein the first tip is connected to the second tip via a second concave surface segment having a radius of 0.05 mm to 0.3 mm.

3. The card clothing wire according to claim 1, wherein the tip surface is defined between the second tip and the back surface and comprises a first tip surface segment, a second tip surface segment, and a third tip surface segment.

4. The card clothing wire according to claim 3, wherein the first tip surface segment is formed as a planar surface.

5. The card clothing wire according to claim 3, wherein the second tip surface segment has a tip surface radius of 0.2 mm to 0.5 mm.

6. The card clothing wire according to claim 1, wherein the second tip has a height difference with respect to the elevation in the tip surface of 0.02 mm to 0.5 mm.

7. The card clothing wire according to claim 1, wherein the card clothing wire has a blade width at the second tip of 0.05 mm to 0.3 mm.

8. The card clothing wire according to claim 1, wherein the card clothing wire has a root width of 0.3 mm to 1.0 mm.

9. The card clothing wire according to claim 1, wherein the elevation has a radius of 0.1 mm to 0.3 mm.

10. A drum for a card machine, comprising the card clothing wire according to claim 1 mounted thereon.

* * * * *